US008210502B2

(12) United States Patent
Fogg et al.

(10) Patent No.: US 8,210,502 B2
(45) Date of Patent: Jul. 3, 2012

(54) ADJUSTABLE WIRELINE SHEAVE FOR HAY PULLEY

(75) Inventors: James Fogg, Gt Yarmouth (GB); Jeremy Ward, Great Yarmouth (GB)

(73) Assignee: Weatherford/Lamb, Inc., Houston, TX (US)

( * ) Notice: Subject to any disclaimer, the term of this patent is extended or adjusted under 35 U.S.C. 154(b) by 399 days.

(21) Appl. No.: 12/485,154

(22) Filed: Jun. 16, 2009

(65) Prior Publication Data

US 2010/0317474 A1 Dec. 16, 2010

(51) Int. Cl.
*B66D 3/04* (2006.01)

(52) U.S. Cl. ..... 254/406; 254/411; 254/412; 254/416; D8/360; 474/199

(58) Field of Classification Search ..... 254/405, 254/406, 411, 412, 416; D8/360; 474/199
See application file for complete search history.

(56) References Cited

U.S. PATENT DOCUMENTS

| | | | | |
|---|---|---|---|---|
| 447,199 | A | 2/1891 | Paul | |
| 2,283,048 | A | 6/1940 | Collett | |
| 3,104,094 | A | 9/1963 | Liem et al. | |
| 3,171,633 | A | 3/1965 | Le Bus, Jr. et al. | |
| 3,292,908 | A | 12/1966 | Thompson | |
| 3,385,563 | A | 5/1968 | Stinson | |
| 3,831,676 | A | 8/1974 | Brown et al. | |
| 4,301,995 | A | 11/1981 | Niskin | |
| 4,469,171 | A | 9/1984 | Mine | |
| 4,480,818 | A | 11/1984 | Frank | |
| 4,610,645 | A * | 9/1986 | Donn et al. | 474/112 |
| 5,078,656 | A | 1/1992 | Brandenstein et al. | |
| 5,645,269 | A | 7/1997 | Peterson | |
| 5,752,892 | A | 5/1998 | Taomo et al. | |
| 6,105,939 | A | 8/2000 | Vance et al. | |
| 6,386,516 | B1 | 5/2002 | Lenders | |
| 6,481,695 | B1 * | 11/2002 | Fuller | 254/405 |
| 6,536,743 | B2 | 3/2003 | Selcer et al. | |
| 6,699,149 | B1 | 3/2004 | White et al. | |
| 7,419,138 | B1 * | 9/2008 | Mauthner | 254/394 |

(Continued)

FOREIGN PATENT DOCUMENTS

GB 2418463 A 3/2006

(Continued)

OTHER PUBLICATIONS

Western Pressure Controls 2005 Ltd., "WPC Wellhead Sheave (Hay Pulley)," Product Specifications, undated.

(Continued)

*Primary Examiner* — Emmanuel M Marcelo
(74) *Attorney, Agent, or Firm* — Wong, Cabello, Lutsch, Rutherford & Bruculerri, LLP

(57) ABSTRACT

A wireline hay pulley has a support with front and back plates extending therefrom. A sheave disposed between the plates can rotate on an axle. The front plate is affixed to the support, while the back plate is removably connected to the support. The front plate has a round opening in which an eccentric bushing on the axle can rotate. When the back plate is disconnected from the support, the back plate can turn the axle fixed in a slotted opening. An eccentric bushing on the axle rotates in an opening of the front plate, thereby shifting the sheave away from the support. With the back plate moved away and the sheave shifted downward, an operator can readily rig up a wireline in the sheave's slot.

23 Claims, 4 Drawing Sheets

U.S. PATENT DOCUMENTS

| | | | | |
|---|---|---|---|---|
| 7,431,269 | B2 | 10/2008 | Carlson et al. | |
| 7,438,281 | B2 | 10/2008 | Pesnel | |
| 2002/0158505 | A1 | 10/2002 | Lund | |
| 2004/0009837 | A1* | 1/2004 | Serkh et al. | 474/135 |
| 2008/0203371 | A1* | 8/2008 | Mauthner | 254/391 |

FOREIGN PATENT DOCUMENTS

| | | | |
|---|---|---|---|
| GB | 2433283 | A | 6/2007 |
| WO | 2006/030186 | A1 | 3/2006 |

OTHER PUBLICATIONS

Cromar, "Slickline Hay Pulleys & Line Wipers," Product Brochure, undated.

Petro Oil Tools, LLC., "7" (0.92") Hay Pulley/Wireline Sheave," obtained from http://www.petrooiltools.com, copyright 2005.

"Hay Pulley for 5/16" Wire," obtained from http://www.dreieservice.no, dated Aug. 19, 2006.

"Hay Pulley for SL og 7/32" Wire," obtained from http://www.dreieservice.no, dated May 26, 2006.

Western Pressure Controls Ltd., "Wellhead Sheave (Hay Pulley)," obtained from http://www.westernpressure.com, copyright 2008.

Rigtrain, Pressure Control Equipment: Fig. 13—Wireline Stuffing Box (Hydraulic), p. 27, copyright 2002.

First Office Action in co-pending U.S. Appl. No. 12/485,195, mailed Dec. 22, 2010.

Reply to First Office Action in co-pending U.S. Appl. No. 12/485,195, filed Mar. 22, 2011.

Final Office Action in co-pending U.S. Appl. No. 12/485,195, mailed Jun. 7, 2011.

Reply to Final Office Action in co-pending U.S. Appl. No. 12/485,195, filed Jun. 17, 2011.

Advisory Action in co-pending U.S. Appl. No. 12/485,195, mailed Jul. 13, 2011.

Reply to Advisory Action in co-pending U.S. Appl. No. 12/485,195, filed Aug. 5, 2011.

Notice of Allowance in co-pending U.S. Appl. No. 12/485,195, mailed Aug. 24, 2011.

* cited by examiner

ADJUSTABLE WIRELINE SHEAVE FOR HAY PULLEY

CROSS-REFERENCE TO RELATED APPLICATIONS

This application is filed concurrently with U.S. patent application Ser. No. 12/485,195, entitled "Adjustable Wireline Sheave for Stuffing Box," which is incorporated herein by reference in its entirety.

BACKGROUND

Sheaves are used to route a wireline between a stuffing box at a wellhead and a wireline unit. For example, one sheave mounts onto the stuffing box for guiding the wireline to and from the stuffing box. Another sheave referred to as a hay pulley or floor block is used to change the wireline's perpendicular direction from the stuffing box sheave to a horizontal direction toward the wireline unit. The hay pulley can be mounted lower on the wellhead below the stuffing box sheave so that side forces on the wellhead can be reduced from the routed wireline. Rigging up a wireline in the various sheaves at a wellhead can be time consuming for operators. Should any adjustments be needed, operators may also need to be able to adjust or fix the wireline rigging in a timely manner.

SUMMARY

A wireline hay pulley can be used to guide a wireline between a wellhead and a wireline unit. The hay pulley has a top block or support with front and back plates extending therefrom. A sheave disposed between the plates can rotate on an axle that is held between the plates. The front plate is affixed to the top block, while the back plate is removably connected to the top block by movable pins. The front plate has a round opening in which an eccentric bushing on the axle can rotate, but the back plate has a slotted opening in which a detent end of the axle fits. When the back plate is disconnected from the top block by removing the pins that hold it, the back plate can be moved to turn the axle fixed in its slotted opening. The eccentric bushing of the axle then rotates in the opening of the front plate, thereby shifting the sheave and back plate connected to the axle away from the top block. With the back plate moved away from the top block and the sheave shifted away, an operator can readily rig up a wireline in the sheave's slot.

The foregoing summary is not intended to summarize each potential embodiment or every aspect of the present disclosure.

DETAILED DESCRIPTION

Figure 1A:
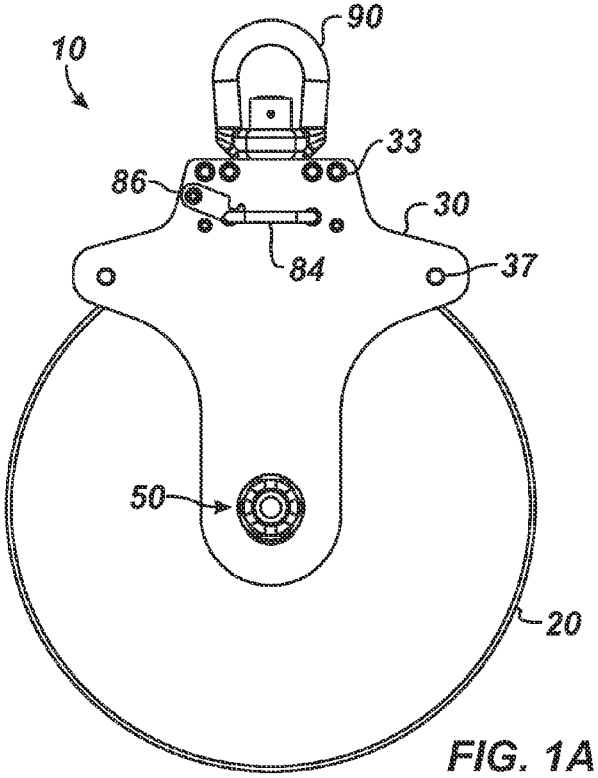
FIGS. 1A-1B show elevational and perspective views of a front side of a hay pulley according to the present disclosure.
Figure 1B:
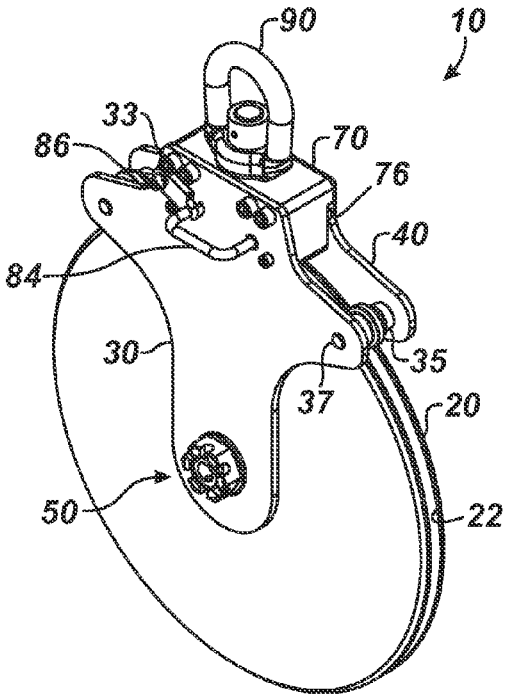
Figure 2A:
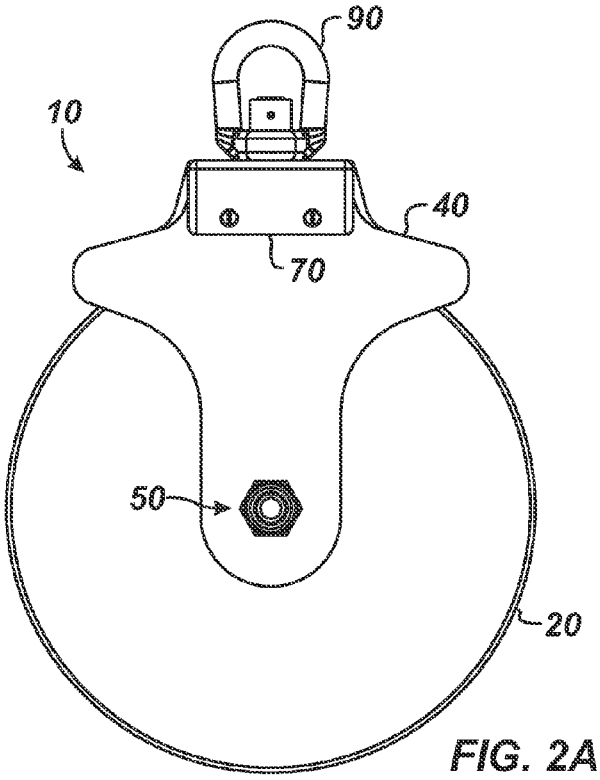
FIGS. 2A-2B show elevational and perspective views of a back side of the hay pulley.
Figure 2B:
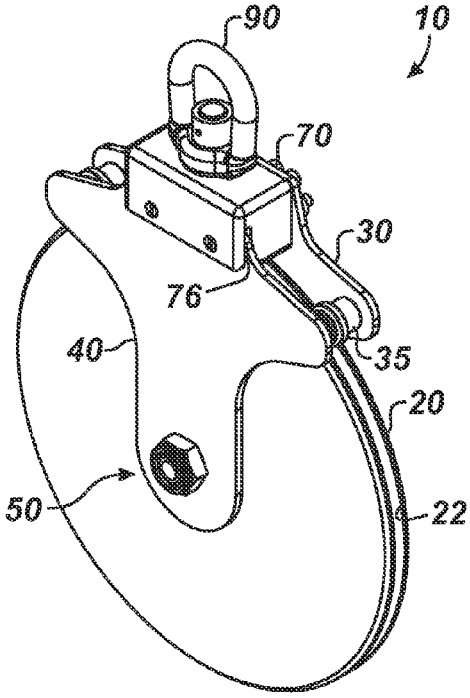

A front view of a hay pulley 10 according to the present disclosure is shown in FIGS. 1A-1B, and a back view of the hay pulley 10 is shown in FIGS. 2A-2B. The hay pulley 10 can be used to guide a wireline for a wireline operation at a wellhead or for some other type of operation. Normally, the hay pulley 10 attaches to the wellhead below a sheave (not shown) at a stuffing box (not shown) on the wellhead. From this position, the hay pulley 10 guides the wireline between the stuffing box sheave and the wireline unit and reduces the lateral force that the wireline exerts on the wellhead.

The hay pulley 10 has a sheave 20, front and back plates 30/40, an axle 50, and a support or top block 70. The sheave 20 can rotate on the axle 50 connected between the plates 30/40. The top block 70 at the upper ends of the plates 30/40 connects to a clevis 90 used for hanging the pulley 10 during use. The top block 70 affixes to the front plate 30 using fasteners 33. However, the back plate 40 fits within a channel 76 in the top block 70 and is held by internal components described below. Pins 37 connected to the front plate 30 but not the back plate 30 support guide wheels 35 near the sheave 20 for guiding a wireline (not shown) that can run in the sheave's slot 22.

Figure 4A:
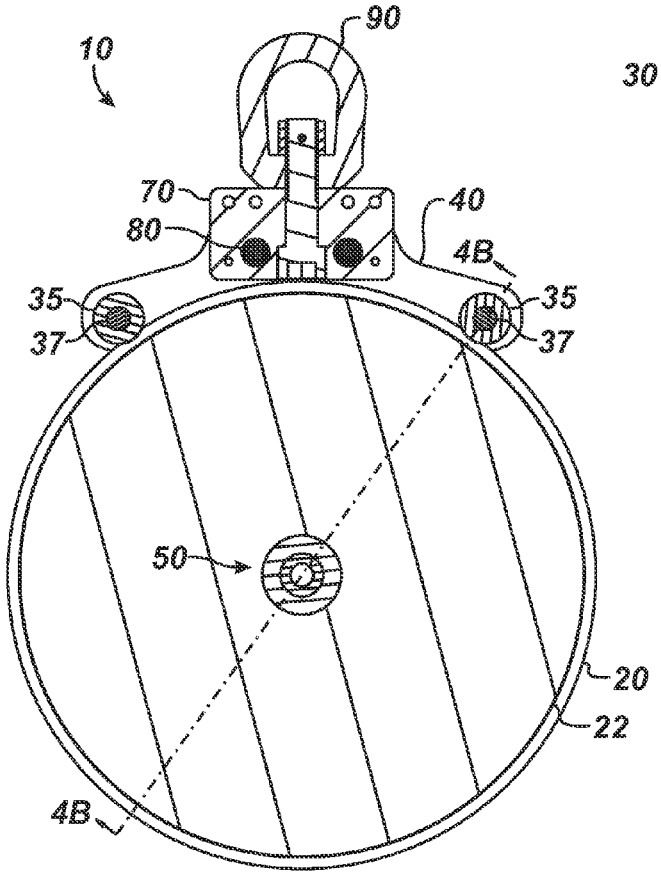
FIG. 4A shows a front cross-section of the hay pulley revealing the sheave, guide wheels, and top block when the hay pulley is in the operating condition.
Figure 4C:
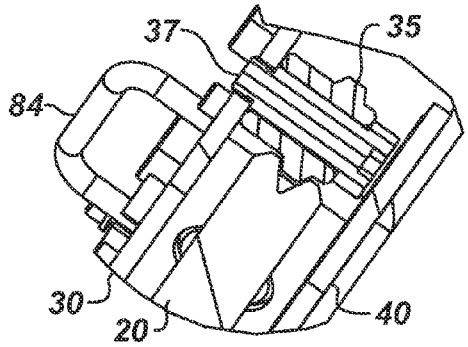
FIG. 4C shows a detail of the side cross-section of FIG. 4B.
Figure 4B:
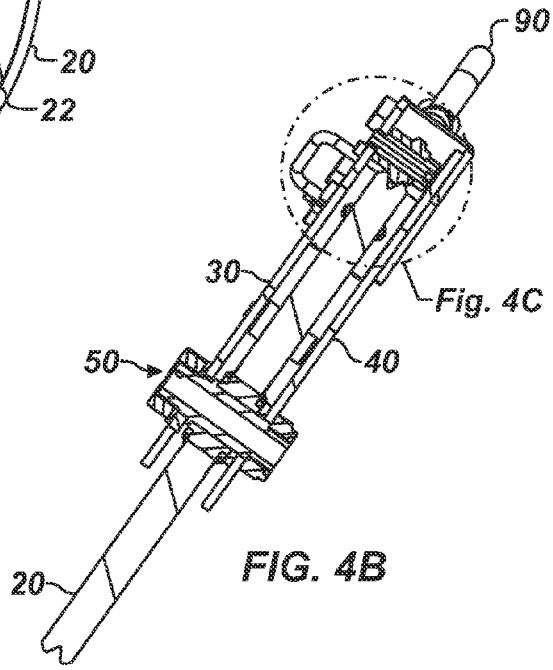
FIG. 4B shows a side cross-section of the hay pulley of FIG. 4A.

FIGS. 1A through 2B show the hay pulley 10 in an operating condition for guiding the wireline. This condition is also shown in the cross-sections of FIGS. 4A-4C. During operation, the sheave 20 supported on the axle 50 has its periphery positioned near the bottom of the top block 70, and the guide wheels 35 on the pins 37 fit partially into the sheave's slot 22 to hold the wireline therein.

To facilitate rigging up the wireline in the sheave's slot 22, however, the pulley's back plate 40 can be moved away from the top block 70, and the sheave 20 itself can also be moved away from the top block 70 and guide wheels 35 so that additional space is provided for fitting the wireline in the slot 22. As explained in more detail below, a retainer removably connects the back plate 40 to the top block 70. The retainer can selectively engage the back plate 40 and hold it to the top block 70 for the operating condition, or the retainer can selectively disengage the back plate 40 so it can be moved to an opened condition.

As shown in FIGS. 1A-1B, the retainer has a handle 84 at the top block 70. Movement of this handle 84 can selectively detach pins 80 that hold the back plate 40 in the top block's rear channel 76. When a lock mechanism 86 is moved, for example, an operator can pull the handle 84 outward from the front plate 30, releasing the pins 80 from the back plate 40. Once freed, the back plate 40 can be rotated away from the top block 70 so that the pulley 10 has an opened condition.

Figure 5A:
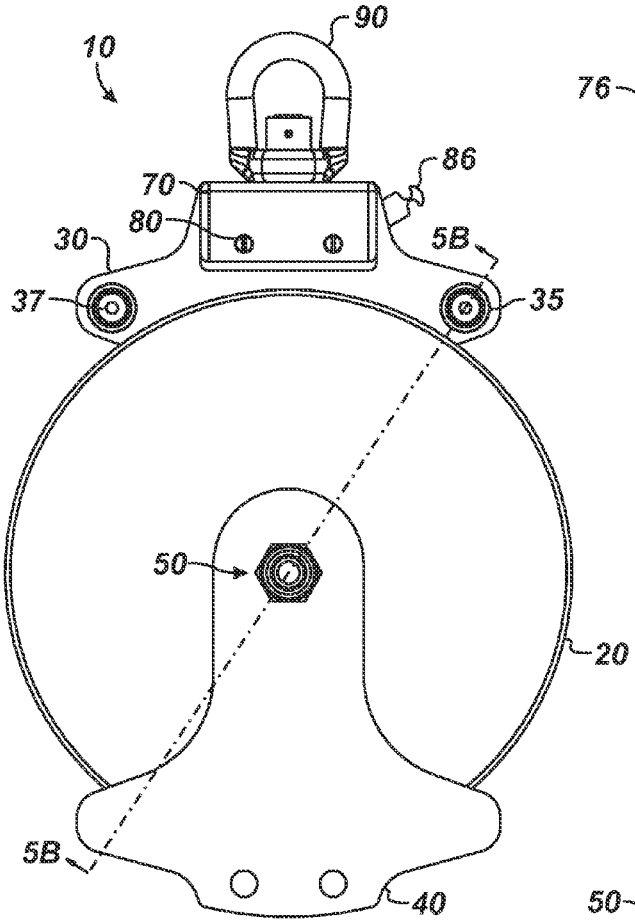
FIG. 5A shows an elevational view of the hay pulley when the hay pulley is in the opened condition.
Figure 5C:
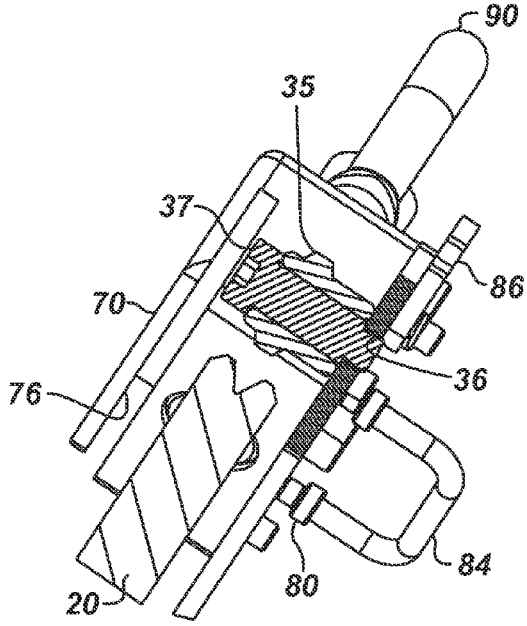
FIG. 5C shows a detail of the side cross-section of FIG. 5B.
Figure 5B:
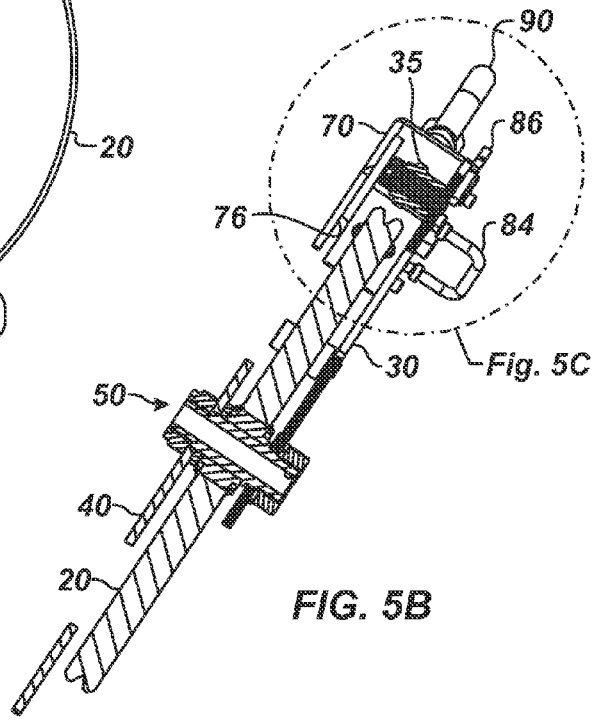
FIG. 5B shows a side cross-section of the hay pulley of FIG. 5A.

Such an opened condition is best shown in FIGS. 5A-5C. In the opened condition, the back plate 40 is freed from the movable pins 80 in the top block 70 by the pulling of the handle 84. Being freed, the back plate 40 can be moved and can turn the axle 50. The rotating axle 50 then eccentrically shifts the sheave 20 downward away from the top block 70 and the guide wheels 35, and the shifted sheave 20 allows operators to install or remove the wireline in the sheave's slot 22. All the while, the hay pulley 10 can remain hanging on the clevis 90.

Figure 3:
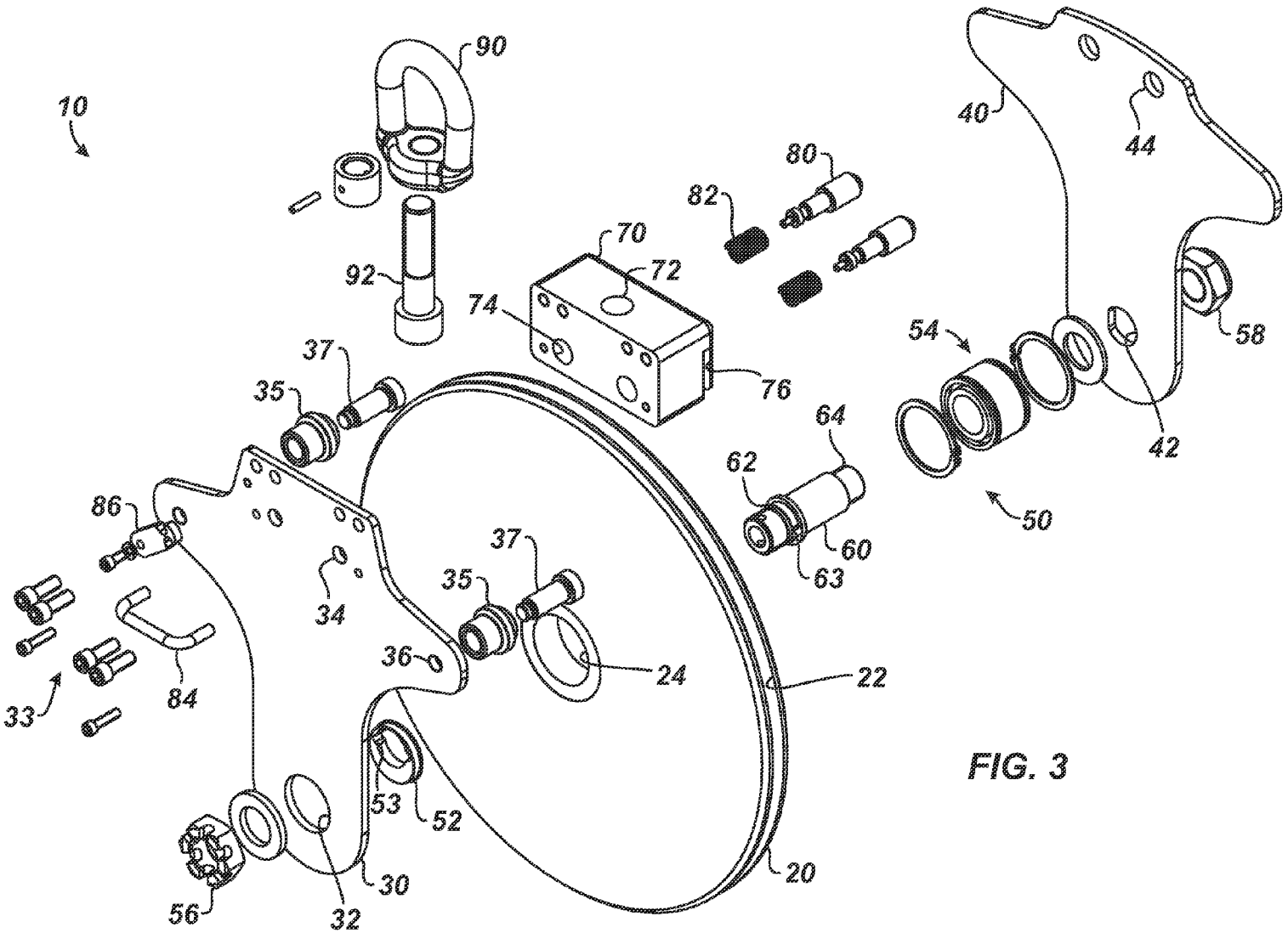
FIG. 3 shows an exploded view of the hay pulley.

Turning to FIG. 3 showing additional details of the hay pulley 10, discussion now turns to how the back plate 40 is held and released from the top block 70 and how the sheave 20 can shift away from the guide wheels 35 when the back plate 40 is moved out of the way. As shown, the top block 70 fastens to the front plate 30 using various fasteners 33. A fastener 92 passes through an opening 72 in the top block 70, and the clevis 90 fastens to this fastener 92.

For the axle 50, an eccentric bushing 52 fits on a first end 62 of a shaft 60, and the bushing 52 positions in a round opening 32 in the front plate 30. A cotter pin type fastener and washer assembly 56 then attaches to the shaft's first end 62, holding it to the plate 30 but allowing it to turn in the opening 32. A bearing assembly 54 slips onto the shaft 60, and a central opening 24 in the sheave 20 fits onto the bearing assembly 54 so the sheave 20 can rotate thereon.

Guide wheels 35 fit onto pins 37, and ends of these pins 37 connect to holes 36 in the front plate 30. The back plate 40 is then positioned on the axle 50 by inserting the shaft's second end 64 into a contoured opening 42 in the back plate 40 and fastening it to a bolt 58 or the like. When an upper end of the back plate 40 is fit into the top block's channel 70, distal ends of the pins 37 for the guide wheels 35 do not connect to the back plate 40.

Inside the top block 70, pins 80 having springs 82 disposed thereon position into side holes 74 in the top block 70. Proximal ends of these pins 80 pass through openings 34 in the front plate 30 and attach to the pulling handle 84 outside the plate 30. Distal ends of the movable pins 80 fit into openings 44 in the back plate 40 so that the pins 80 can hold the end of the back plate 40 in the top block's channel 76. The lock 86 that connects to the front plate 30 can be moved relative to the handle 30 to selectively engage a shoulder on one of the pins 80 and to prevent the pins 80 from being moved by the handle 84.

Returning to additional details of the shaft 60, the shaft's second end 64 has a detent that fits into the back plate's opening 42 with a corresponding contour so the shaft 60 is prevented from rotating in the opening 42. However, rotation of the back plate 40 relative to the top block 70 turns the shaft 60 of the axle 50. At its other end 62, the shaft 60 has keys 63 next to a lip. These keys 63 fit into a corresponding opening 53 in the eccentric bushing 52. Therefore, the bushing 52 turns with the shaft 60 and rotates in the round opening 32 in the front plate 30 when turned.

When the back plate 40 is unlocked from the top block 70 and then rotated to the opened condition (e.g., FIG. 5A), the back plate 40 rotates the shaft 60 carrying the sheave 20. The rotating shaft 60 turns the eccentric bushing 52 in the front plate's round opening 32. As the shaft 60 turns eccentrically with the bushing 52, both the back plate 40 and sheave 20 drop clear of the top block 70 until reaching the opened condition shown in FIG. 5A. As a result, the rotated back plate 40 is moved out of the way of the top block 70 allowing an operator to rig up the wireline on the sheave 20, and the sheave 20 dropped down from the top block 70 gives the operator additional space to rig up the wireline in the sheave's slot 22.

Although shown as having the separate eccentric bushing 52 disposed on the shaft 60, it will be appreciated that an axle for the disclosed hay pulley 10 can have such an eccentric bushing integrally formed on the axle for fitting into a round opening of the front plate 30. In addition, although the shaft 60 has the detent end 64 fitting into the back plate's contoured opening 42 so that turning of the back plate 40 rotates the shaft 60, other types of connections could be used.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wireline hay pulley, comprising:

a support;

first and second plates disposed adjacent one another, the first plate affixed to the support, the second plate removably connected to the support;

an axle disposed between the first and second plates, the axle being eccentrically rotatable relative to the first plate and being rotatable by the second plate when disconnected from the support; and a sheave rotatably disposed on the axle between the first and second plates.

2. The pulley of claim 1, further comprising:

a pin disposed on the first plate; and a wheel rotatably disposed on the pin adjacent a periphery of the sheave.

3. The pulley of claim 1, wherein an end of the axle is eccentrically rotatable in a first opening in the first plate.

4. The pulley of claim 3, wherein the axle comprises:

a shaft having a first end; and an eccentric bushing disposed on the first end and rotatable in the first opening in the first plate.

5. The pulley of claim 1, wherein an end of the axle is fixedly connected to the second plate.

6. The pulley of claim 5, wherein the axle comprises a shaft having a detent in one end, the detent disposing in a contoured opening in the second plate.

7. The pulley of claim 1, further comprising a bearing disposed on the axle and disposed in a central opening in the sheave.

8. The pulley of claim 1, further comprising a retainer removably connecting the second plate to the support.

9. The pulley of claim 8, wherein the retainer comprises at least one pin movably disposed in the support and having a distal end selectively engagable in at least one hole in the second plate.

10. The pulley of claim 9, further comprising a handle connected to a proximal end of the at least one pin, the handle moving the at least one pin relative to the at least one hole.

11. The pulley of claim 9, further comprising a lock disposed on the first plate, the lock being selectively engagable with the at least one pin.

12. The pulley of claim 1, wherein the support defines a slot through which an edge of the second plate movably positions.

13. A wireline hay pulley, comprising:

a support;

a first plate affixed to the support and having a first opening;

a second plate disposed adjacent the first plate and removably connected to the support;

an axle disposed between the first and second plates, the axle having a first end eccentrically rotatable in the first opening, the axle having a second end affixed to the second plate, the axle being rotatable by the second plate when disconnected from the support; and a sheave rotatably disposed on the axle between the first and second plates.

14. The pulley of claim 13, further comprising:

a pin disposed on the first plate; and a wheel rotatably disposed on the pin adjacent a periphery of the sheave.

15. The pulley of claim 13, wherein the first end of the axle has a bushing disposed eccentrically to an axis of the axle and rotatably disposed in the first opening.

16. The pulley of claim 13, wherein the second end of the axle defines a detent, and wherein the second plate defines a second opening in which the detent of the second end fits.

17. The pulley of claim 13, further comprising a bearing disposed on the axle and disposed in a central opening in the sheave.

18. The pulley of claim 13, further comprising a retainer removably connecting the second plate to the support.

19. The pulley of claim 18, wherein the retainer comprises at least one pin movably disposed in the support and having a distal end selectively engagable in at least one hole in the second plate.

20. The pulley of claim 19, further comprising a handle connected to a proximal end of the at least one pin, the handle moving the at least one pin relative to the at least one hole.

21. The pulley of claim 19, further comprising a lock disposed on the first plate, the lock being selectively engagable with the at least one pin.

22. The pulley of claim 13, wherein the support defines a slot through which an edge of the second plate movably positions.

23. A wireline hay pulley, comprising:

a support;

a first plate affixed to the support and having a round opening;

a second plate removably connected to the support and having a slotted opening;

a retainer removably connecting the second plate to the support;

a shaft disposed between the first and second plates and having first and second ends, the second end having a detent disposed in the slotted opening of the second plate, the shaft being turnable by movement of the second plate;

an eccentric bushing disposed on the first end of the shaft, the eccentric bushing rotatable with the shaft and rotatably disposed in the round opening of the first plate; and a sheave rotatably disposed on the shaft between the first and second plates.

* * * * *